US005597245A

United States Patent [19]

Meyerhoff

[11] Patent Number: 5,597,245

[45] Date of Patent: Jan. 28, 1997

[54] CAVITATION SUPPRESSING DUCTED PROPELLER SYSTEM

[75] Inventor: Leonard Meyerhoff, New York, N.Y.

[73] Assignee: The United States of America as represented by the Secretary of the Navy, Washington, D.C.

[21] Appl. No.: 217,257

[22] Filed: Aug. 13, 1962

[51] Int. Cl.[6] ..... B63H 5/15

[52] U.S. Cl. ..... 440/67; 440/49; 440/6; 415/221

[58] Field of Search ..... 115/42, 34; 114/57; 170/172, 156, 135.4; 60/35.5; 230/170, 116, 122, 136; 253/77 H, 77 PO; 440/67; 415/221, 115; 416/90 R

[56] References Cited

U.S. PATENT DOCUMENTS

| | | | |
|---|---|---|---|
| 285,002 | 9/1883 | Borgfeldt | 440/49 |
| 1,190,755 | 7/1916 | Hahn | 416/20 R |
| 1,667,506 | 4/1928 | Bankrat | 416/91 |
| 1,857,509 | 5/1932 | Holmstrom | 416/90 R |
| 2,689,541 | 9/1954 | Williams | 416/90 R |
| 2,714,886 | 8/1955 | Pleuger et al. | 440/6 |
| 2,756,713 | 7/1956 | Kort | 415/119 |
| 3,096,930 | 7/1963 | Meyerhoff | 62/506 |

FOREIGN PATENT DOCUMENTS

| | | | |
|---|---|---|---|
| 768647 | 5/1934 | France | 416/90 R |
| 776656 | 11/1934 | France | 416/90 R |
| 22309 | of 1897 | United Kingdom | 416/90 R |
| 400913 | 3/1932 | United Kingdom | 62/506 |

*Primary Examiner*—Michael J. Carone
*Assistant Examiner*—M. J. Lattig

[57] ABSTRACT

This invention relates to a device for use with a ducted propeller system for suppressing gap cavitation between a moving rotor tip and duct wall and more particularly to means for supplying fluid to a ducted propeller whereby cavitation or the noise resulting therefrom may be eliminated.

2 Claims, 3 Drawing Sheets

CAVITATION SUPPRESSING DUCTED PROPELLER SYSTEM

This invention relates to a device for use with a ducted propeller system for suppressing gap cavitation between a moving rotor tip and duct wall and more particularly to means for supplying fluid to a ducted propeller whereby cavitation or the noise resulting therefrom my be minimized.

Cavitation is known to occur in or near the clearance gap between the moving rotor tip and duct wall of a ducted propeller. This cavitation, which is associated with the existence of the gap, is believed to result from a reduction of pressure in the flow to the vapor pressure, within or near the aforementioned clearance gap. The collapse of the cavitation bubbles, particularly against the propeller blade and duct walls, has been found to be a source of noise in the water and is subject, therefore, to detection by underwater detection equipment. In order to escape detection it becomes desirable to eliminate as much noise as possible.

In accordance with the present invention the noise generated by cavitation in the area of the rotor tip is minimized by injecting a fluid into the gap area between the rotor tip and the duct to increase the pressure within the cavitation bubbles and in effect cushion their collapse. The addition of fluid to the gap is also believed to raise the local pressure in the gap area and thereby delay the onset of cavitation.

An object of the present invention therefore, is to minimize noise generated by cavitation in a ducted propeller.

A further object is to provide a method and system for raising the local pressure in the rotor tip area of a ducted propeller system to thereby delay the onset of cavitation and to reduce the noise generated by cavitation after its onset.

Other objects and any of the attendant advantages of this invention will be readily appreciated as the source becomes better understood by reference to the following detailed description when considered in connection with the accompanying drawings in which like reference numerals designate like or corresponding parts throughout the several views and wherein.

Figure 1:
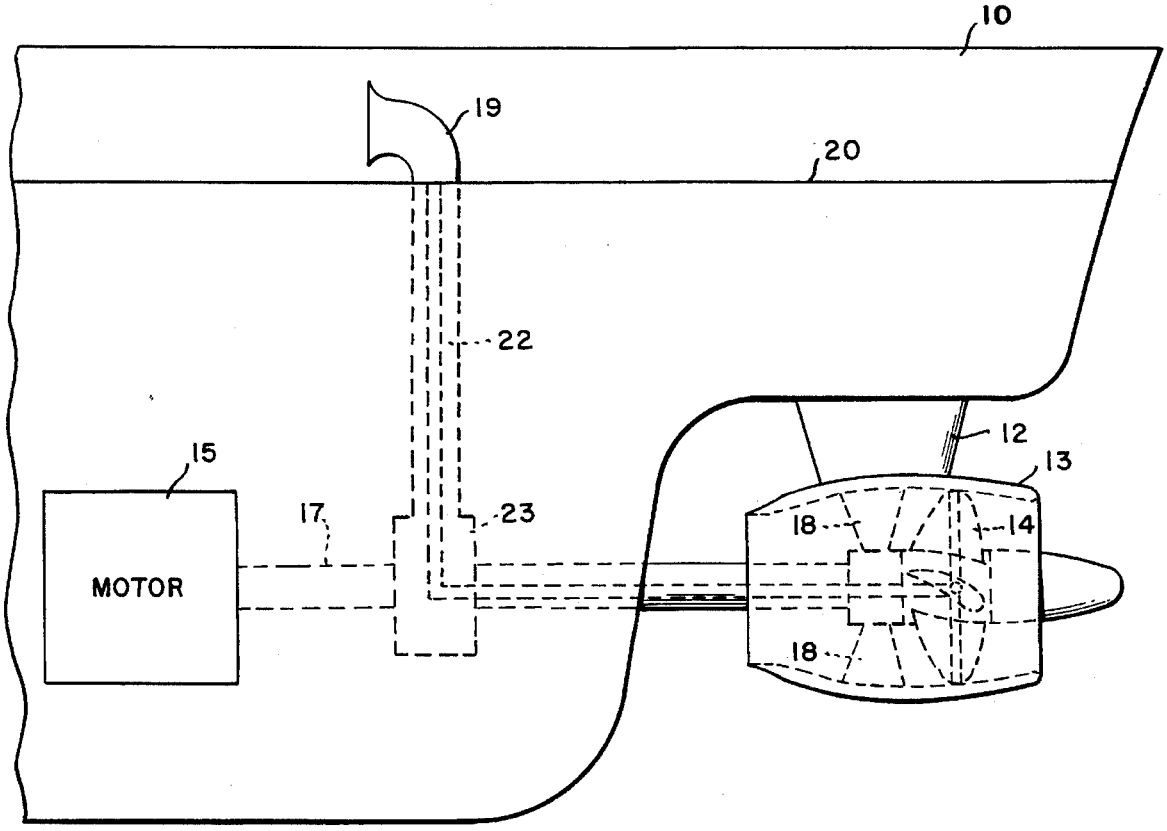
FIG. 1 is a partly diagrammatical view in side elevation of an embodiment of a ducted propeller system mounted on the bow of a boat and having an air intake for cavitation noise suppression.

Referring now to the drawings, wherein like reference characters designate like or corresponding parts throughout the several views there is shown in FIG. 1 a side elevation view of an embodiment of the invention mounted on the bow of a ship 10. A duct strut 12 supports a duct 13 for a propeller 14. A motor 15 drives a hollow shaft 17 which extends out from ship 10 to rotate propeller 14. A plurality of stator blades 18 extend inwardly from duct 13 and have a shaft bearing 21, as shown more clearly on FIG. 2, to support the propeller shaft 17.

In order to supply air to the propeller blades, an air inlet 19, which may be above the ship's waterline 20, conducts air through a tube 22 to a rotating coupling unit 23 to supply air to the hollow shaft 17.

Figure 2:
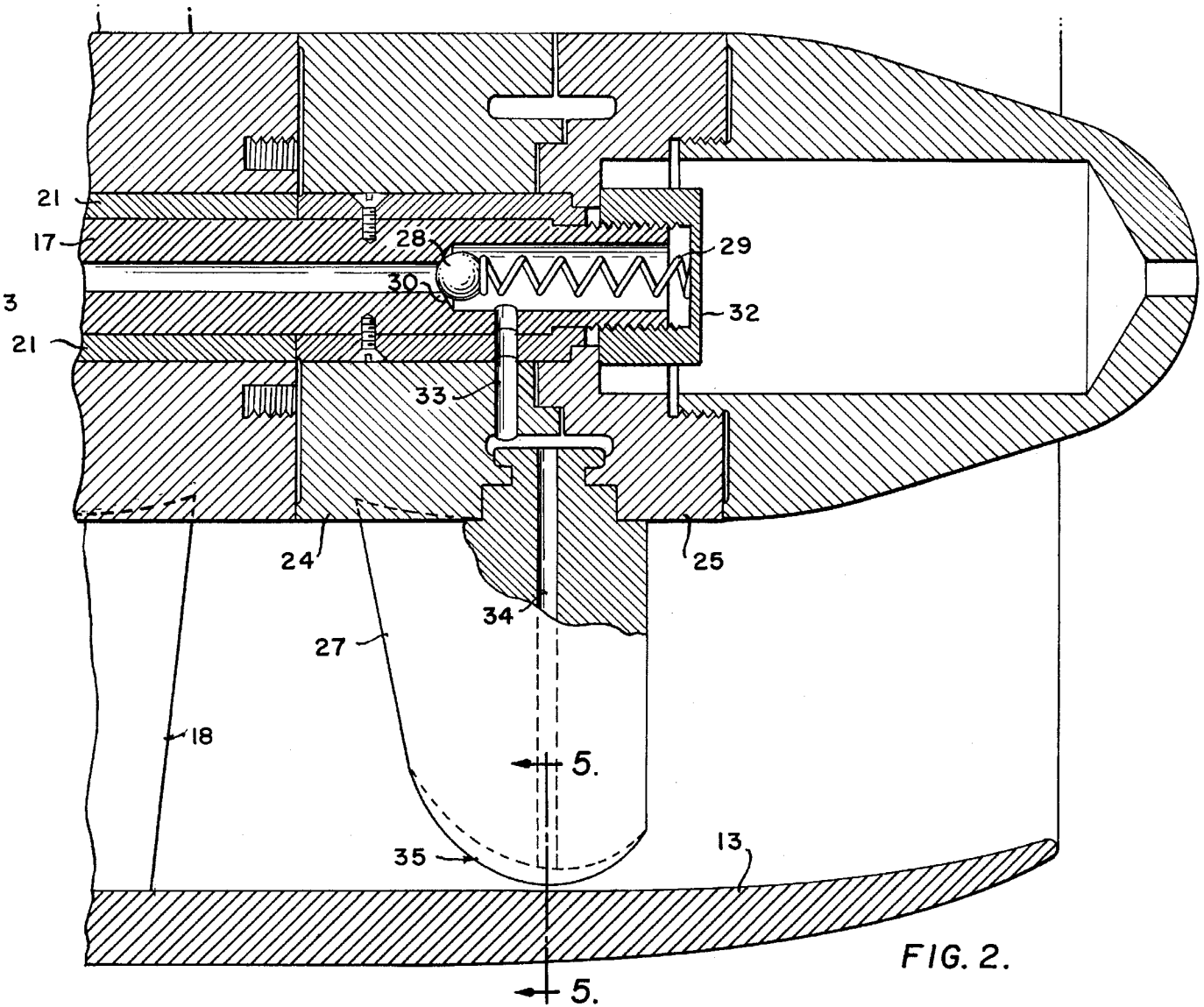
FIG. 2 is a detailed cross-sectional view of the propeller, shaft, and duct of FIG. 1.

As may be seen more clearly in FIG. 2, hollow shaft 17 rotates in sleeve bearing 21 and has attached thereto a pair of fairing units 24 and 25 for clamping the propeller blades 27. In order to prevent reverse flow of water into the hollow shaft 17, a check valve having a ball 28 is urged by a spring 29 into a valve seat 30. A threaded cap 32 mounted on the end of the shaft 17 allows assembly of the ball 28 and the spring 29.

The air from hollow shaft 17 is led through the hole 33 in the fairing unit 24 and through the hole 34 in the center of the propeller blade 27 to the tip area 35 of the blade.

Figure 5:
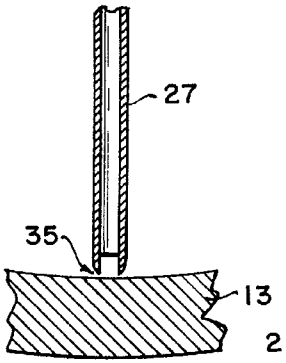
FIG. 5 is a cross-sectional view of the propeller and duct taken along lines 5—5 of FIG. 2.

As shown in FIG. 5, which is a cross-sectional view taken along lines 5—5 of FIG. 2, the tip area 35 of the blade 27 is slotted to allow the air to move along the entire length of the tip of blade 27 and to escape in the gap between the blade R7 and the duct 13.

Figure 6:
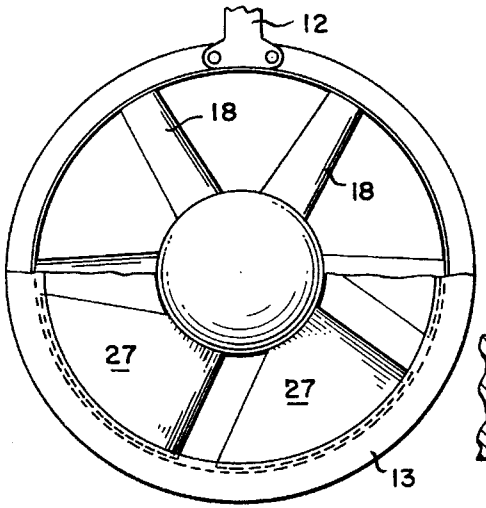
FIG. 6 is a front elevation view of the ducted propeller showing the stator and rotor blades.

As indicated by FIG. 6, which is a front elevation view of the propeller system, the propeller blades 27 are fan shaped and have very little clearance between the tip area 35 and the duct 13.

In operation, when the fluid pressure near the blade tip goes below atmosphere pressure and cavitation bubbles are formed, the spring loaded valve opens and air is exhausted through shaft 17, the blades 27, and into tip area 35. The vapor bubbles will then entrain some air which acts as an elastic cushion when the cavitation bubbles collapse, to thereby minimize cavitation noise.

While the system of FIG. 1 is operable if there is an adequate air supply, the invention is not limited by that particular requirement.

Figure 3:
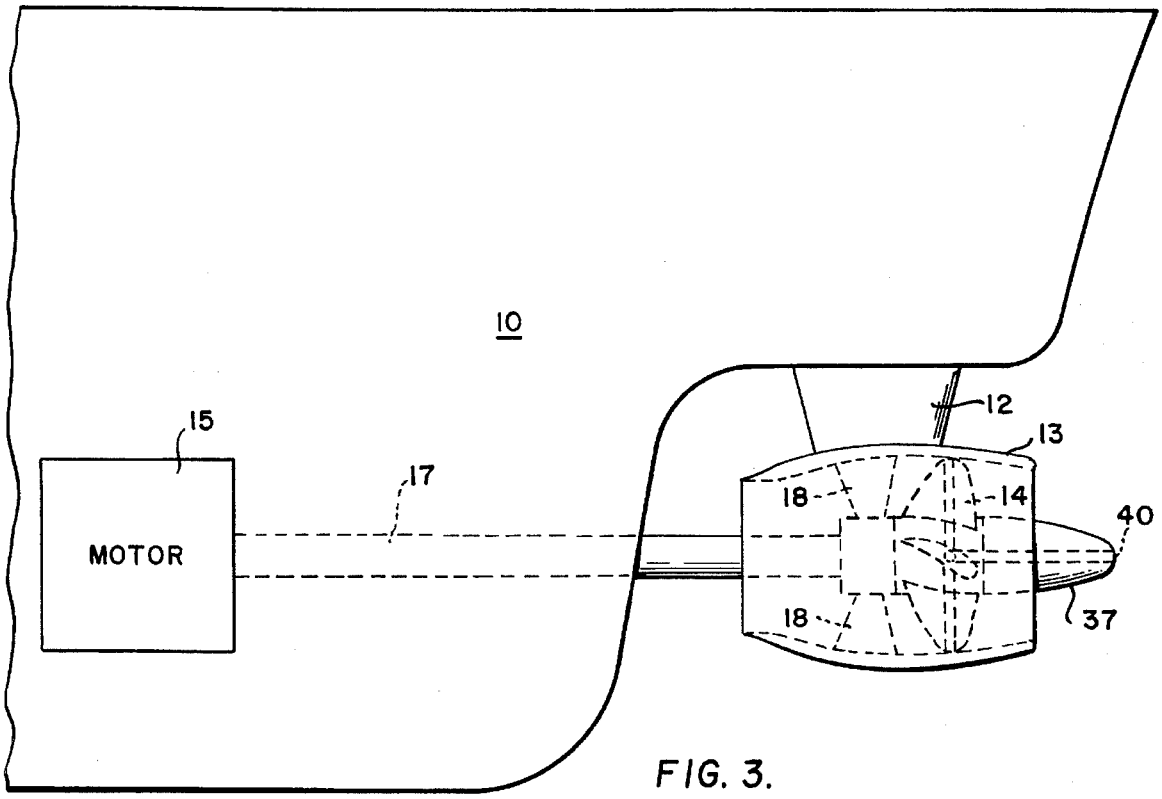
FIG. 3 is a side elevation view of the ducted propeller system having a fluid intake in the shaft.

FIG. 3 shows a system generally similar to FIG. 1 but where the propeller shaft is either solid or plugged up and the hub fairing 37 has a fluid inlet 38 for exhausting the ambient fluid into the tip area. As shown more clearly on FIG. 4, which is a cross-sectional view of part of FIG. 3, shaft 17 is solid and an opening 40 in the hub fairing 37 allows the ambient fluid, such as water, to enter hub fairing 37 and to be impelled by the centrifugal force of the propeller blades to blade tip area 35 to delay the onset of cavitation and minimize the cavitation noise and erosion Since no outside air supply is needed for the embodiment of FIGS. 3 and 4, extra pipes and rotating joints are not needed and the system may be used for submarines, for example.

Although the invention may be used for planes in air or in any fluid, the methods of operation of the suppression of cavitation noise in the two embodiments are somewhat different. In FIGS. 1 and 2, air as a compressible fluid is introduced into the blade tip area where the relatively incompressible fluid, such as water, is forming vapor bubbles. Therefore, the collapse of the vapor bubble is cushioned by the elasticity of the compressible fluid and cavitation noise is reduced but cavitation is not reduced.

Figure 4:
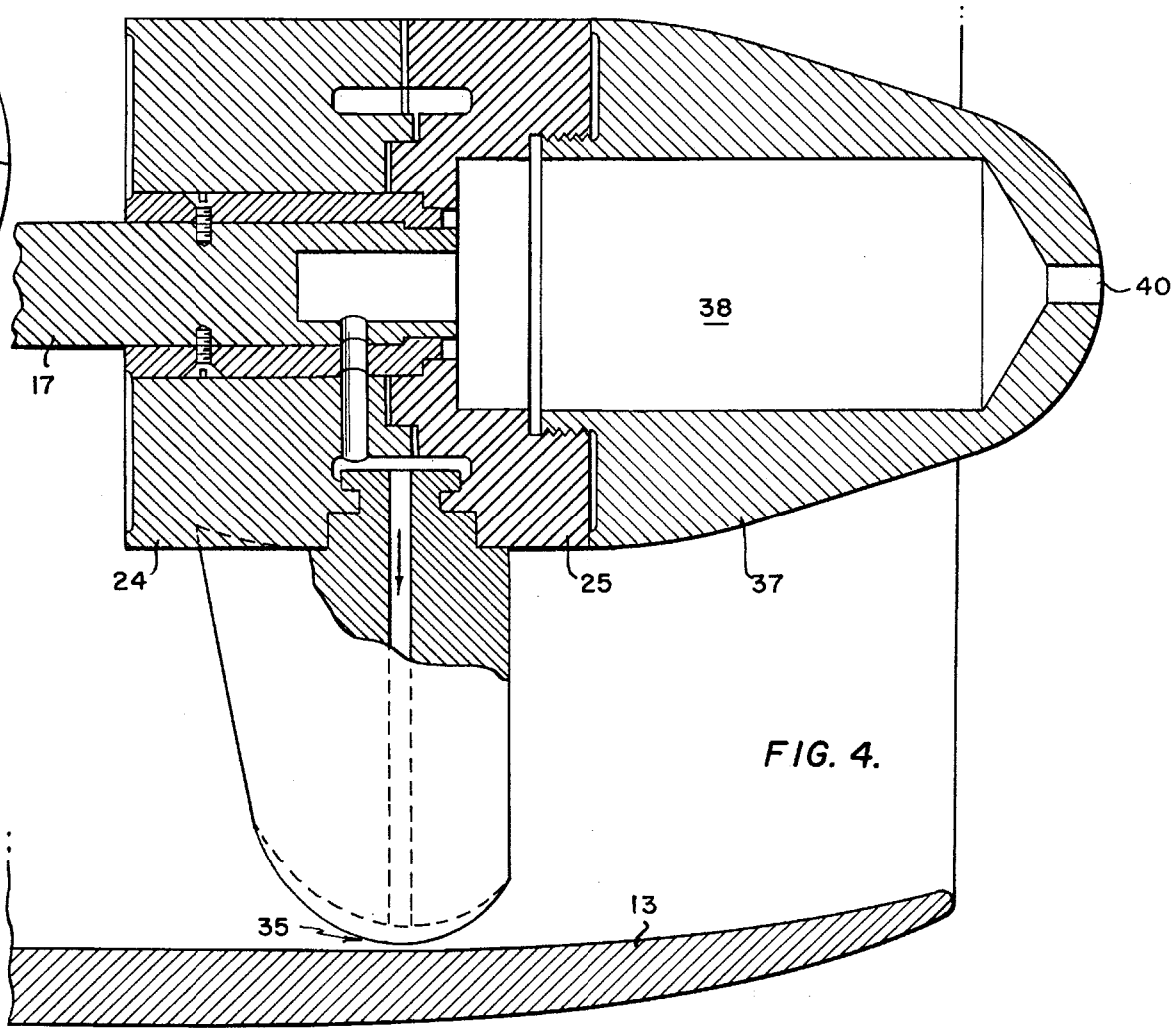
FIG. 4 is a detailed cross-sectional view of the shaft, propeller, and duct of FIG. 3.

In contrast in FIGS. 3 and 4, the fluid introduced at the blade tip has the same compressibility as the ambient fluid and no "cushion" is introduced into the vapor bubbles. Instead the local pressure at the tip area is increased to raise the local pressure above the cavitation point.

It is believed that the introduction of the fluid at the blade tip area is most effective since that is where cavitation begins. The introduction of the fluid through the shroud along the blade tip path would also serve the same purpose but would require a peripheral nozzle that might require an increased air or fluid supply. In addition, there is a possibility that the introduction of air or any other fluid on the inside of the shroud would create additional noise.

The present invention, therefore, requires the least amount of added fluid to minimize cavitation noise and is therefore the most efficient and least expensive.

The invention as shown on the drawings uses a propeller with a divergent-convergent duct to create a decrease in fluid flow velocity and thereby an increase in fluid pressure to raise the cavitation point of the propeller. This so-called "pump-jet" type of duct and propeller is therefore also of some benefit in raising the cavitation point.

However, the invention of suppressing cavitation noise at the gap between the duct and propeller is not limited to this type of duct and divergent, convergent, or combination type ducts may be used.

Obviously many modifications and variations of the present invention are possible in the light of the above teachings. It is therefore to be understood that within the scope of the appended claims the invention may be practiced otherwise than as specifically described.

What is claimed:

1. A ducted propeller system comprising a propeller having a plurality of blades, a duct fixedly mounted in position around said propeller and having a diameter such that the most radial peripheral portion of said blades rotate in close proximity to said duct, a hollow shaft connected at one end to said propeller for driving said propellers a fluid inlet means connected to said hollow shaft, a peripheral slot in the surface of the propeller blade tips facing the inner surface of said duct wall of each of said propeller blades, said blades further defining an internal passage interconnecting said slot and said hollow shaft whereby fluid supplied to said fluid inlet is discharged through said slot to the area between the duct and the tips of said blades to minimize cavitation in said area.

2. A ducted propeller system as claimed in claim 1 in which said hollow shaft has a check valve mounted in a hollow portion therein to prevent the entrance of fluid when the pressure of the ambient fluid exceeds the pressure of the fluid to be discharged through said slot.

* * * * *